US008730118B1

(12) United States Patent
McLean

(10) Patent No.: US 8,730,118 B1
(45) Date of Patent: May 20, 2014

(54) BICONICAL ANTENNA WITH EQUAL DELAY BALUN AND BIFURCATING GROUND PLANE

(75) Inventor: James McLean, Austin, TX (US)

(73) Assignee: TDK Corporation, Chiba (JP)

( * ) Notice: Subject to any disclaimer, the term of this patent is extended or adjusted under 35 U.S.C. 154(b) by 400 days.

(21) Appl. No.: 13/154,606

(22) Filed: Jun. 7, 2011

Related U.S. Application Data

(60) Provisional application No. 61/352,553, filed on Jun. 8, 2010.

(51) Int. Cl.
*H01Q 13/00* (2006.01)

(52) U.S. Cl.
USPC ..... 343/773

(58) Field of Classification Search
USPC ..... 343/772, 773, 774, 775
See application file for complete search history.

(56) References Cited

U.S. PATENT DOCUMENTS

| | | | | |
|---|---|---|---|---|
| 4,700,196 | A * | 10/1987 | Campbell et al. | 343/797 |
| 5,523,767 | A * | 6/1996 | McCorkle | 343/810 |
| 6,154,182 | A * | 11/2000 | McLean | 343/773 |
| 6,198,454 | B1 * | 3/2001 | Sharp et al. | 343/773 |
| 7,215,292 | B2 * | 5/2007 | McLean | 343/725 |
| 7,221,326 | B2 * | 5/2007 | Ida et al. | 343/773 |
| 7,859,478 | B2 * | 12/2010 | McLean | 343/860 |
| 8,228,257 | B2 * | 7/2012 | Lalezari | 343/850 |

OTHER PUBLICATIONS

McLean et al., "Analysis of the Equal-Delay Transformer with Non-commensurate Constituent Transmission Lines," 2010 Asia-Pacific Symposium on Electromagnetic Compatibility, Apr. 2010, pp. 91-94.
Baum et al., "Sensors for Electromagnetic Pulse Measurements Both Inside and Away from Nuclear Source Regions," IEEE Transactions on Electromagnetic Compatibility, vol. EMC-20, No. 1, Feb. 1978, pp. 22-35.

* cited by examiner

*Primary Examiner* — Seung Lee
(74) *Attorney, Agent, or Firm* — Kevin L. Daffer; Daffer McDaniel LLP

(57) ABSTRACT

A biconical antenna driven by an equal-delay transformer is provided herein with a bifurcating ground plane. According to one embodiment, the biconical antenna comprises a pair of cone-shaped elements and a conducting ground plate. The cone-shaped elements are arranged back-to-back to one another and aligned along a first axis. The conducting ground plate is arranged between the cone-shaped elements in a plane perpendicular to the first axis. As described herein, the bifurcating ground plane provides the decoupling needed to eliminate the anomalous undulations, which tend to occur in the antenna response at odd-integer average quarter-wave frequencies.

19 Claims, 8 Drawing Sheets

BICONICAL ANTENNA WITH EQUAL DELAY BALUN AND BIFURCATING GROUND PLANE

BACKGROUND OF THE INVENTION

1. Field of the Invention

This invention relates to antenna design and, more particularly, to biconical antennas employing equal-delay or Guanella baluns.

2. Description of the Related Art

The following descriptions and examples are given as background only.

The equal-delay or Guanella balun is one of the most common broadband transformer and balun topologies. Absent imperfections, the topology is pulse preserving and hence is frequently employed as a pulse transformer. It is often combined with antennas used for EMC testing, including the broadband wire-cage biconical antenna, as well as some implementations of the Impulse Radiating Antenna (IRA).

A particularly robust implementation of this topology, which is based on a pair of bifilar helical transmission lines is widely used with broadband wire-cage biconical antennas for Electromagnetic Susceptibility (EMS) testing from 30-300 MHz. This implementation differs from most equal-delay designs in that the electrical lengths of the constituent transmission lines are electrically long over most of the operating frequency range. The electrically long structure provides the necessary choking reactance in the absence of ferrite cores. The absence of ferrite is quite advantageous for sustained high power operation.

FIG. 1 depicts an embodiment of an equal delay balun with a generalized load to represent an antenna driven from a coaxial feed line. The shunt-series interconnection of the constituent transmission line elements provides a 1:4 impedance transformation, which is useful for broadband antenna matching. In the ideal case, in which the constituent transmission lines of the balun are equal in electrical length ($\theta_A=\theta_B$) and characteristic impedance ($Z_{0A}=Z_{0B}$), the operation of the equal-delay transformer/balun is frequency independent and maximum power transfer occurs when the impedance of the source ($Z_g$) is ½ ($Z_{0A}=Z_{0B}$) and the impedance of the load ($Z_L$) is $2(Z_{0A}=Z_{0B})$.

However, imperfections in the balun tend to destroy the equal-delay nature of the device, and hence, its fundamental frequency independence. While it is reasonable to assume that the characteristic impedance of the two constituent transmission lines can be made essentially equal through precise manufacturing, it is nearly impossible to make the electrical length of the transmission lines perfectly equal. Even small differences in electrical length can cause dramatic variations in performance, thus preventing the equal delay transformer/balun from reaching idealized performance.

When the electrical lengths of the two constituent transmission lines are not commensurate (i.e., not perfectly equal), the balun tends to exhibit anomalies at odd-integer multiples of the average quarter-wave frequency of the two constituent transmission lines. When combined with a radiating structure (such as a broadband wire-cage biconical antenna), these anomalies manifest themselves in the antenna's response, and may involve undulations in the power transfer, peaks in the return loss of the system, and excitation of the common mode of the radiating structure.

Therefore, a need exists for a modification to conventional biconical antenna designs employing equal-delay baluns. Specifically, a need exists for a modification that would prevent the anomalies that necessarily occur in the equal-delay balun (due to imperfections in the balun) from manifesting themselves in the antenna's response.

SUMMARY OF THE INVENTION

The following description of various embodiments of a biconical antenna and method for improving the performance of a biconical antenna is not to be construed in any way as limiting the subject matter of the appended claims.

According to one embodiment, the performance of a biconical antenna with equal-delay balun is greatly improved by the addition of a bifurcating ground plane. For example, the biconical antenna may comprise a pair of cone-shaped elements and a conducting ground plate. The cone-shaped elements may be arranged back-to-back to one another and aligned along a first axis. The cone-shaped elements may be implemented in a variety of ways including, but not limited to, elements formed from a substantially solid electrically-conductive material, elements formed from a wire-mesh, electrically-conductive material, and elements formed by coupling together a plurality of metal wires or rods to form an "open" or "closed" cone-shaped structure.

The conducting ground plate (otherwise referred to as the "bifurcating ground plane") may be arranged between the cone-shaped elements in a plane perpendicular to the first axis (i.e., in the H-plane of the biconical antenna). In addition, the bifurcating ground plane may be arranged, such that a center of the ground plate is located at an intersection of the first axis and the plane perpendicular to the first axis. The bifurcating ground plane may be formed from substantially any electrically-conductive material, may have a finite thickness, and may have a smoothly contoured shape with symmetry in at least one dimension. Although the bifurcating ground plane may be of substantially any shape or size, a substantially circular ground plane of relatively small size (i.e., smaller than the width of the antenna elements) is generally preferred when the physical size of the antenna is such that handling and assembling is difficult. As described herein, the bifurcating ground plane provides the decoupling needed to eliminate the anomalous undulations, which tend to occur in the antenna response at odd-integer multiples of 90° average electrical length of the constituent transmission lines in the equal delay balun.

The equal delay balun (otherwise referred to as an equal delay transformer or Guanella balun) is coupled for driving the pair of cone-shaped elements. In one embodiment, the equal delay balun may be configured as a voltage balun by connecting a sum-port of the equal-delay transformer to the bifurcating ground plane. This configuration enables the cone-shaped elements to be driven with voltages that, with respect to the bifurcating ground plane, are equal in magnitude but opposite in phase. In one embodiment, the equal-delay transformer may be enclosed in, or embedded within, a cavity of the bifurcating ground plane to electrically isolate the equal-delay transformer from the cone-shaped elements. In a preferred embodiment, the equal-delay transformer may be implemented as a pair of bifilar helical transmission lines.

A method for improving the performance of a biconical antenna driven by an equal-delay transformer is also provided herein. In one embodiment, the method may include arranging a conducting ground plate (i.e., a bifurcating ground plane) within the H-plane of the biconical antenna, such that the conducting ground plate bifurcates radiating elements of the biconical antenna. The ground plate may be arranged between the antenna elements during a manufacturing step before the antenna/ground plate assembly is shipped to a customer, or as a retrofit to an existing biconical antenna. The method may also include connecting a sum-port of the equal delay transformer to the conducting ground plane, such that the radiating elements of the biconical antenna are driven with voltages that, with respect to the conducting ground plate, are substantially equal in magnitude but opposite in phase. In some embodiments, the method may also include placing the equal delay transformer within a cavity created within the conducting ground plate to electrically isolate the equal delay transformer from the radiating elements of the biconical antenna. In general, the steps of arranging, connecting and placing improve the performance of the biconical antenna by eliminating the anomalous undulations that would otherwise occur in the antenna response due to mismatches in electrical length of transmission lines included within the equal delay transformer.

BRIEF DESCRIPTION OF THE DRAWINGS

Other objects and advantages of the invention will become apparent upon reading the following detailed description and upon reference to the accompanying drawings in which.

Figure 1:
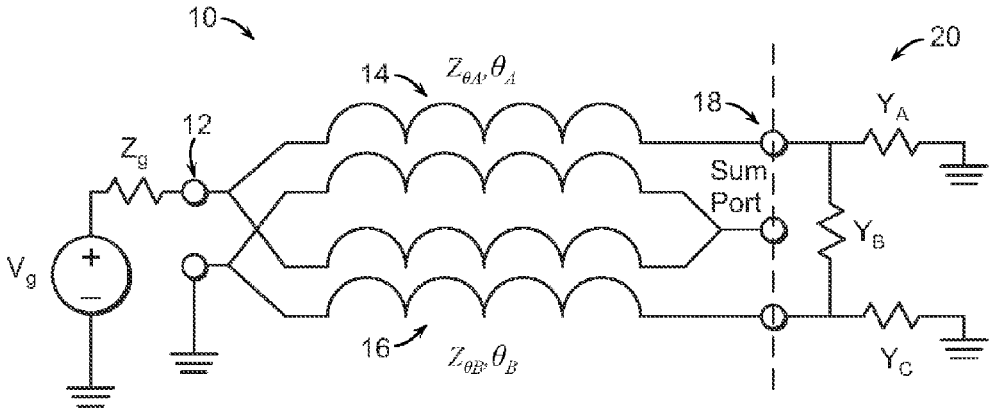
FIG. 1 is a schematic diagram illustrating an equivalent network representing a combined equal-delay balun and antenna system represented as a three-terminal load.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

As noted above, the topology of the idealized equal-delay or Guanella balun is pulse preserving and frequency independent. However, realistic implementations of the equal-delay balun produce far from ideal responses that exhibit anomalies at odd-integer multiples of the average quarter-wave frequency of the constituent transmission lines. When combined with a radiating structure (such as a broadband wire-cage biconical antenna), these anomalies manifest themselves in the antenna's response, and may involve undulations in the power transfer, peaks in the return loss of the system, and excitation of the common mode of the radiating structure. For a typical high power balun employing bifilar helical transmission lines for use with a 1.4 meter wire-cage biconical antenna, such as the ETS_Lindgren model 3109 design, the anomalous behavior can be seen at approximately 70 MHz, which is approximately the average quarter-wave frequency of the two constituent transmission lines, as well as the fundamental series resonance of the biconical antenna.

Balun imperfections are known for causing the combined balun/antenna system to exhibit anomalous undulations in the antenna response near the average quarter-wave frequency. As indicated above, balun imperfections are typically due to disparities in the electrical length of the constituent transmission lines, as disparities in characteristic impedance do little to degrade the operation of the device. After much investigation, however, the inventor realized that balun imperfections are not solely responsible for the anomalous undulations in the antenna's response. While investigating other causes, the inventor recognized two specific situations involving the equal-delay balun where the effects of non-commensurate constituent transmission lines were most significant. To understand these situations, it is helpful to consider the antenna as a generalized load on the balun.

FIG. 1 is a schematic diagram illustrating an equivalent network representing an equal-delay balun 10 and an antenna system 20, which is represented as a generalized load. In particular, FIG. 1 illustrates an equivalent network of a Guanella 4:1 impedance transformer (equal-delay balun) 10 having a pair of input ports 12, a pair of constituent transmission lines 14, 16, and a three-terminal output port 18 for connecting to a load. As described in more detail below, the sum port of the equal delay transformer can be connected in a variety of ways to implement a voltage balun, a current balun or a 180° power divider.

In FIG. 1, $\theta_A$ and $\theta_B$ are the electrical lengths and $Z_{0A}$ and $Z_{0B}$ are the characteristic impedances of the two constituent transmission lines 14, 16. In the ideal case, in which the constituent transmission lines of the balun are perfectly equal (i.e., commensurate) in electrical length ($\theta_A=\theta_B$) and characteristic impedance ($Z_{0A}=Z_{0B}$), the operation of the equal-delay transformer/balun is frequency independent and maximum power transfer occurs when the impedance of the source ($Z_g$) is ½($Z_{0A}=Z_{0B}$) and the impedance of the load ($Z_L$) is 2($Z_{0A}=Z_{0B}$). In reality, however, it is nearly impossible to make the electrical length of the transmission lines perfectly equal. Since even small differences in electrical length can cause dramatic variations in performance, the effects of non-commensurate transmission lines prevent the equal delay transformer/balun from reaching idealized performance.

The two-port, three-terminal Π or Δ network on the right side of FIG. 1 is the most general representation of an antenna driven from a coaxial transmission line via a balun, and may be used to illustrate the two limiting cases in which the inventor found the effects of non-commensurate constituent transmission lines to be most significant.

In the first case, when the antenna represented by the load 20 is well removed from any external coupling (e.g., coupling to ground or other objects), the antenna behaves as though it were in free space. Under these conditions, $Y_A=Y_C=0$ and only the bridging admittance $Y_B$ remains, such that the load admittance $Y_L=Y_B$. In this case, the 3-terminal load 20 shown in FIG. 1 degenerates to an isolated 2-terminal impedance 30, as shown in the equivalent diagram of FIG. 2. When the antenna behaves as an isolated 2-terminal impedance, the anomalous undulations in the response tend to be the strongest, as shown in FIG. 3 and described in more detail below. It should be recognized that while a free space environment is the most ideal for the antenna, it unfortunately results in poor performance for the non-ideal equal-delay balun.

In the second case, the use of an ideal current balun effectively open circuits the "ground" terminal of the antenna equivalent network. While such a configuration is useful when the antenna is operated near ground and is vertically polarized, such that neither $Y_A$ nor $Y_C$ is zero and $Y_A \neq Y_C$, the asymmetry of the equivalent load causes common mode current to flow on the exterior of the feed transmission line. To eliminate common mode current on the exterior of the coaxial feed line, a current balun can be employed (e.g., by open-circuiting the sum port of balun 10) to enforce current balance at the antenna terminals. However, this effectively causes the current balun to act as a 2-terminal source, thus disconnecting the "ground" terminal in the two-port antenna representation. When an ideal current balun is employed, the load (as seen by the balun) is effectively reduced to a single two-terminal impedance: $Y_L=Y_B+(1/Y_A+1/Y_C)^{-1}$. While the current balun configuration is desirable when the antenna is vertically polarized and situated near a ground plane, opening the sum terminal (to produce the current balun configuration) is undesirable as it greatly exacerbates the anomalies at the odd-integer average quarter-wave frequencies.

The two above-mentioned cases can be summarized as follows: If the antenna acts as an isolated two-terminal load and choking action of the coaxial feed lines is perfect, or if the sum connection of the balun is open-circuited, the transformer effectively becomes a simple series-shunt interconnection of two transmission lines. When the characteristic impedances of the two constituent transmission lines are equal to each other and equal to the optimum value (i.e., when $Z_{0A}=Z_{0B}=2Z_g=\frac{1}{2}Z_L$), but the transmission line lengths are non-commensurate (i.e., $\theta_A \neq \theta_B$), the voltage transfer function becomes:

$$\frac{V_L}{V_G}=\frac{2e^{-j\left(\frac{\theta_A+\theta_B}{2}\right)}\cos\left(\frac{\theta_A+\theta_B}{2}\right)\cos\left(\frac{\theta_A-\theta_B}{2}\right)}{e^{j\left(\frac{\theta_A+\theta_B}{2}\right)}+e^{-j\left(\frac{\theta_A+\theta_B}{2}\right)}\cos^2\left(\frac{\theta_A-\theta_B}{2}\right)}. \quad \text{EQ. 1}$$

As can be seen in EQ. 1, there are zeros in the voltage transfer function when the average electrical length of the transmission lines $[(\theta_A+\theta_B)/2]$ is an odd integer multiple of 90°. These zeros undesirably result in notches in the voltage transfer function, as illustrated for example in FIG. 3.

In FIG. 3, the magnitude of the voltage transfer function predicted by EQ. 1 is plotted versus the average electrical length of the constituent transmission lines. As shown clearly in FIG. 3, notches corresponding to zeros in the voltage transfer function occur at odd integer multiples of 90°. The width of the notches depends on how non-commensurate the transmission lines actually are (e.g., commensurate, ±5%, ±10%, ±100% mismatch). However, in all cases, the nulling is perfect. In practice, the depth of the notches is limited by incomplete choking action as well as dissipation.

In an effort to avoid the undesirable effects shown in FIG. 3, many manufacturers limit the operation of the combined antenna/balun system to below the average fundamental quarter-wave frequency or between two consecutive odd integer multiples of the quarter-wave frequency (e.g., between two notches in the voltage transfer function of FIG. 3). In the first case, the choking reactance would be limited and in the second the maximum attainable fractional bandwidth would be 3:1. Such operation is simply undesirable. Thus, an alternative option is provided in FIGS. 4-10.

Figure 2:
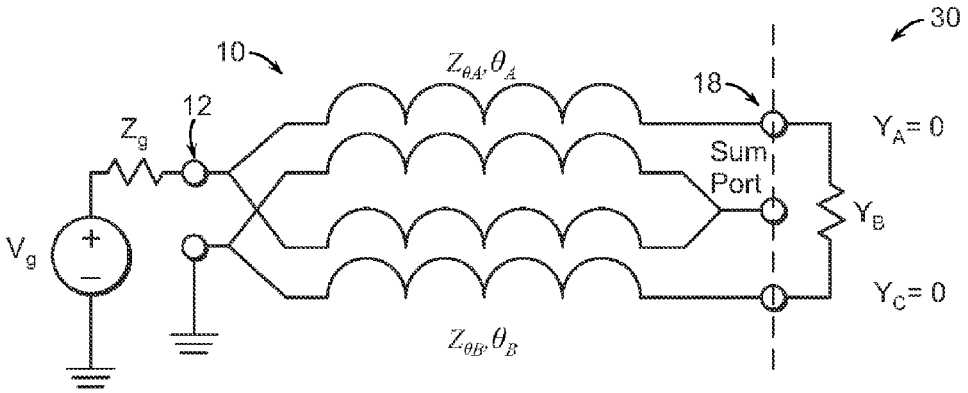
FIG. 2 is a schematic diagram illustrating the case in which the antenna represented by the load is well removed from any external coupling, wherein the three-terminal load shown in FIG. 1 degenerates to an isolated 2-terminal impedance.
Figure 3:
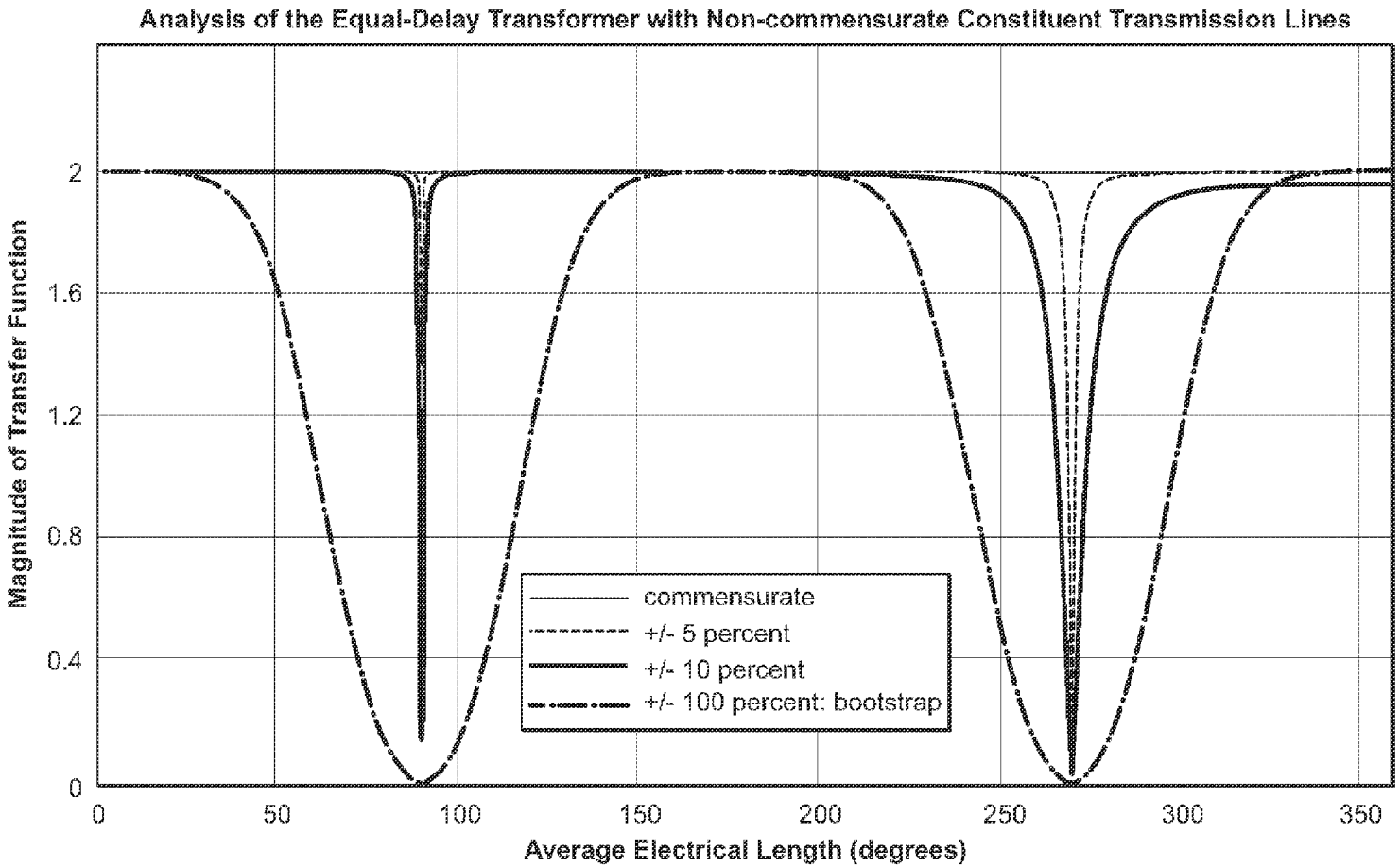
FIG. 3 is a graph plotting the magnitude of the voltage transfer function predicted by EQ. 1 versus the average electrical length of the constituent transmission lines.
Figure 4:
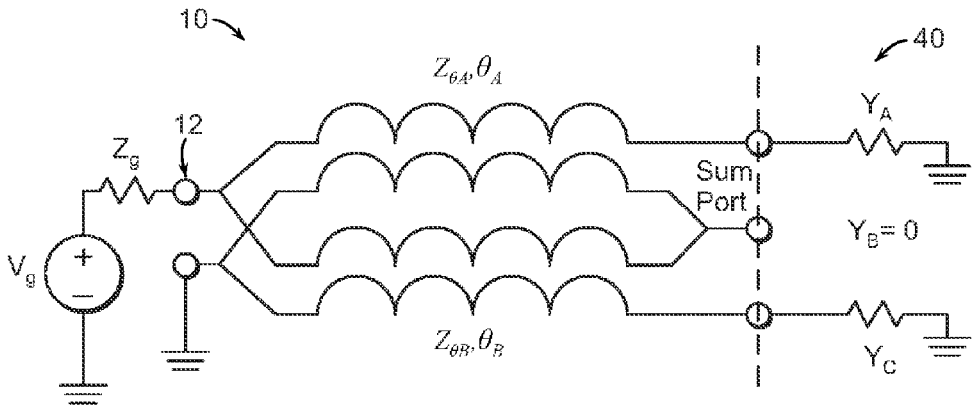
FIG. 4 is a schematic diagram illustrating the case in which the elements of the antenna represented by the load are located on opposite sides of a bifurcating ground plane.

FIG. 4 represents the case in which an antenna represented by a load 40 is operated near an infinite ground plane (i.e., neither $Y_A$ nor $Y_C$ is zero), but unlike the network shown in FIG. 2, the elements of the antenna are located on opposite sides of the ground plane. Such a ground plane is described herein as a bifurcating ground plane and may be implemented with a conducting plate, as described in more detail below. The two-port equivalent network shown in FIG. 4 represents the case in which two antenna elements are separated by a bifurcating ground plane located in the plane, which is perpendicular to the dipole axis of the antenna elements (i.e., in the H-plane of the antenna). More specifically, FIG. 4 is an equivalent network diagram illustrating the effects of such a ground plane on the load 40. When a bifurcating ground plane is sandwiched between the antenna elements, $Y_B=0$ (or at least, $Y_B$ is very small compared to $Y_A$ and $Y_C$) and the equivalent two-port network shown in FIG. 1 degenerates to two shunt admittances ($Y_A$ and $Y_C$) to ground, as shown in FIG. 4.

Now, if we define the output of the balun 10 to be the difference of the two voltages across the two shunt resistances to ground, the voltage transfer function becomes:

$$\frac{V_L}{V_G}=\frac{V_{L1}-V_{L2}}{V_G}=e^{-j\left(\frac{\theta_1+\theta_2}{2}\right)}\cos\left(\frac{\theta_1-\theta_2}{2}\right). \quad \text{EQ. 2}$$

As shown clearly in EQ. 2, the resulting voltage transfer function has a simple cosine dependence on the difference in electrical length $(\theta_1-\theta_2)$. This means that very little degradation of the response will occur when the constituent transmission lines are only slightly non-commensurate. In one example, a 10° difference in electrical length $(\theta_1-\theta_2)$ may cause approximately 2% variation in the load voltage $(V_L)$.

A bifurcating ground plane is particularly useful when the equal-delay balun represented in FIG. 4 is combined with a biconical antenna, as this antenna's response tends to be particularly affected by the anomalies mentioned above. A schematic diagram of a biconical antenna 50 with equal-delay balun 60 and bifurcating ground plane 70 is shown in FIG. 5.

Figure 5:
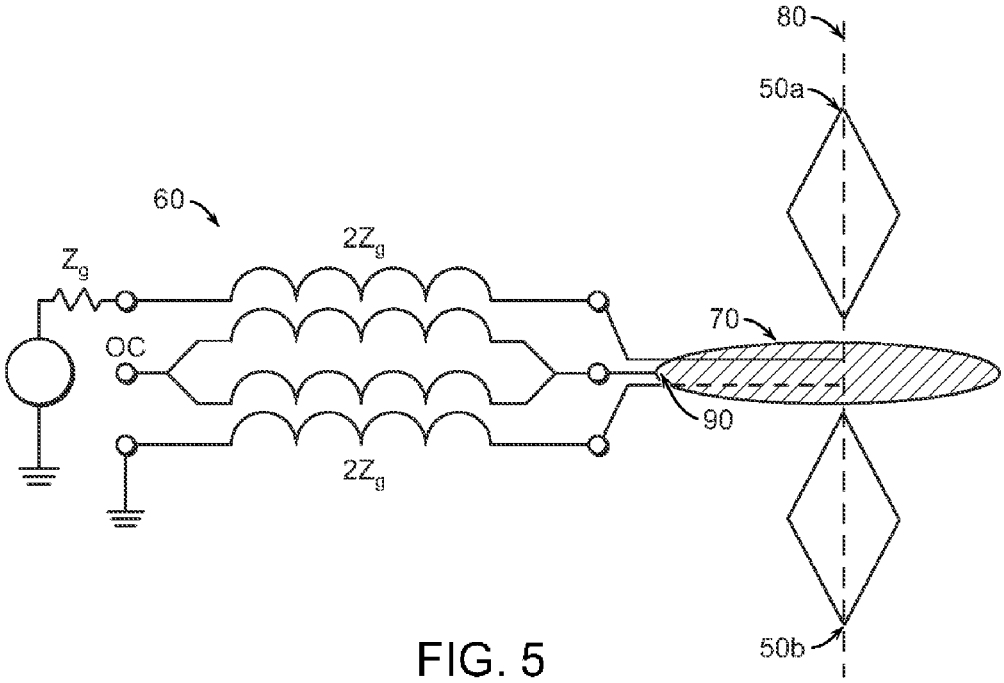
FIG. 5 is a schematic diagram depicting the load shown in FIG. 4 as a biconical antenna with a bifurcating ground plane.

As shown schematically in FIG. 5, the biconical elements 50*a*, 50*b* are decoupled by the ground plane 70, which is located between the biconical elements in the H-plane of the antenna. Such decoupling eliminates the anomalous undulations (e.g., the notches or nulls shown in FIG. 3), which tend to occur in the antenna response at odd-integer multiples of 90° average electrical length of the constituent transmission lines in the equal delay balun.

In the illustrated embodiment, the bifurcating ground plane is implemented as a substantially circular conducting plate arranged, such that the center of the plate is located at the center of the biconical dipole. However, the conducting plate is not limited to substantially circular shapes, and may be implemented with substantially any other smoothly contoured shape in other embodiments of the invention. Although substantially any shape of ground plane may provide an improvement, it is generally desirable to avoid shapes with sharp corners, as sharp discontinuities in the contour tend to produce diffracted rays. In one embodiment, a smoothly contoured ground plate having symmetry in at least one dimension may be desired. For example, an elliptical shape may be useful for maintaining the pattern and for connecting the exterior of the coaxial feed line to the ground plane.

The conducting ground plate may be fabricated from substantially any electrically conductive material, with suitable options comprising aluminum, magnesium and other conductive materials, such as metal loaded polymer composites. In one embodiment, the conducting ground plate may be fabricated from a honeycomb aluminum composite material, such as used in air/space craft, to reduce the weight of the ground plate. As noted below, the plate does not need to be particularly large in order to greatly improve the performance of the antenna. Thus, the addition of a bifurcating ground plane may substantially eliminate the anomalous undulations in the biconical antenna's response without making the design too unwieldy.

In one embodiment, the biconical antenna shown in FIG. 5 may be formed by arranging a pair of cone-shaped elements 50*a*, 50*b* "back-to-back" to one another and aligning the cone-shaped elements along a dipole axis 80, which extends through a center point of the elements along a length of the elements. In some cases, the cone-shaped elements of the biconical antenna may be formed from a substantially solid, electrically-conductive material. For example, each cone-shaped element may be cut, or otherwise formed, from a solid piece of metal (e.g., copper, aluminum, etc.), which may or may not include a hollow center. In other cases, the cone-shaped elements may be fabricated by bending a substantially flat piece of wire mesh into a three-dimensional, cone-shaped structure. In one preferred embodiment, the cone-shaped elements may each be formed by coupling together a plurality of metal wires or rods to form a cone-shaped structure. Such an embodiment is referred to as a "wire-cage" implementation, and may be preferred in some embodiments of the invention, as it simplifies the manufacturing process and provides a robust antenna design.

Figure 6A:
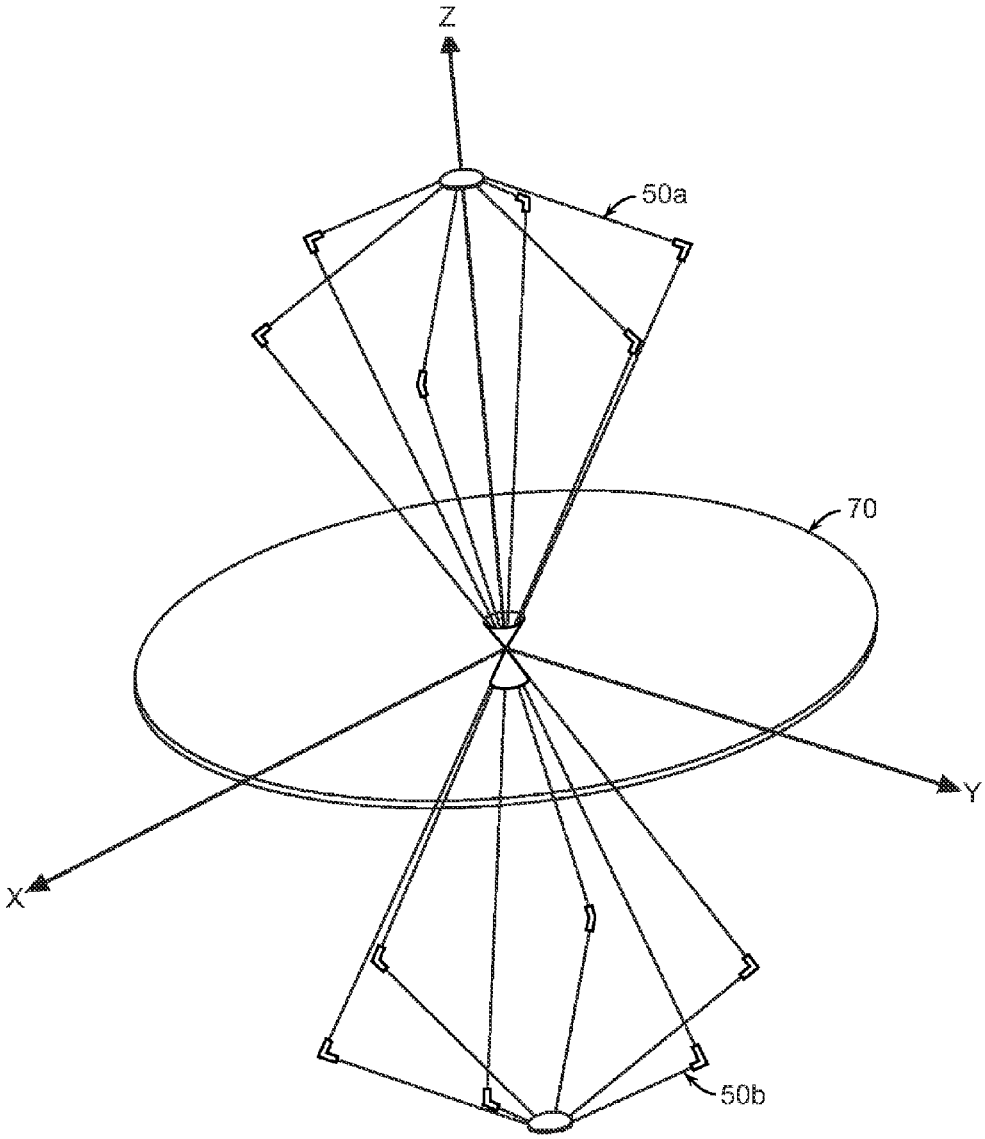
FIG. 6A is a three-dimensional view of a wire-cage biconical antenna with bifurcating ground plane.

FIG. 6A illustrates one embodiment of a "wire-cage" implementation, in which a plurality of metal wires or rods are coupled together to form a pair of "closed" cones 50*a*, 50*b*. In some embodiments (not shown), the end portions of the wire-cage implementation shown in FIG. 6A may be omitted to form a pair of "open" cones.

Regardless of the particular manner in which the biconical antenna is formed, the dimensions of the antenna may be chosen based on a desired operating frequency range of the antenna. In one embodiment, the biconical antenna may be formed with a 60° cone angle and may be about 1.4 meters in width. One reason for choosing such a cone angle is that a 60° cone provides approximately two octaves of operating bandwidth over which it is relatively well matched to a 200 Ohm source and provides a useable pattern. However, other angles and widths are certainly possible and within the scope of the invention.

In the embodiment of FIG. 5, the bifurcated biconical antenna is driven by a 1:4 equal-delay transformer 60, which includes a pair of constituent transmission lines each having a characteristic impedance of $2Z_g$, where $Z_g$ is the source impedance. The equal-delay transformer 60 shown in FIG. 5 is configured as a voltage balun by connecting the sum port of the balun to the bifurcating ground plane (at 90). In this configuration, the equal delay transformer 60 drives the antenna/ground plane combination, such that the ground plane 70 is at zero potential with respect to the two voltages applied to the bases of the biconical elements 50*a*, 50*b*. In other words, the biconical elements 50*a*, 50*b* are driven with voltages that, with respect to the ground plane 70, are equal in magnitude but opposite in phase.

In one embodiment, the equal-delay transformer 60 may be implemented as a pair of bifilar helical transmission lines, as this embodiment provides a substantially robust, high-power design. In a preferred embodiment, the bifilar helical transmission lines 60 are incorporated into the bifurcating ground plane 70 to electrically isolate the transmission lines from the antenna elements. For example, the bifilar helical transmission lines may be embedded and/or enclosed within a cavity or other structure created within the ground plane.

Figure 6B:
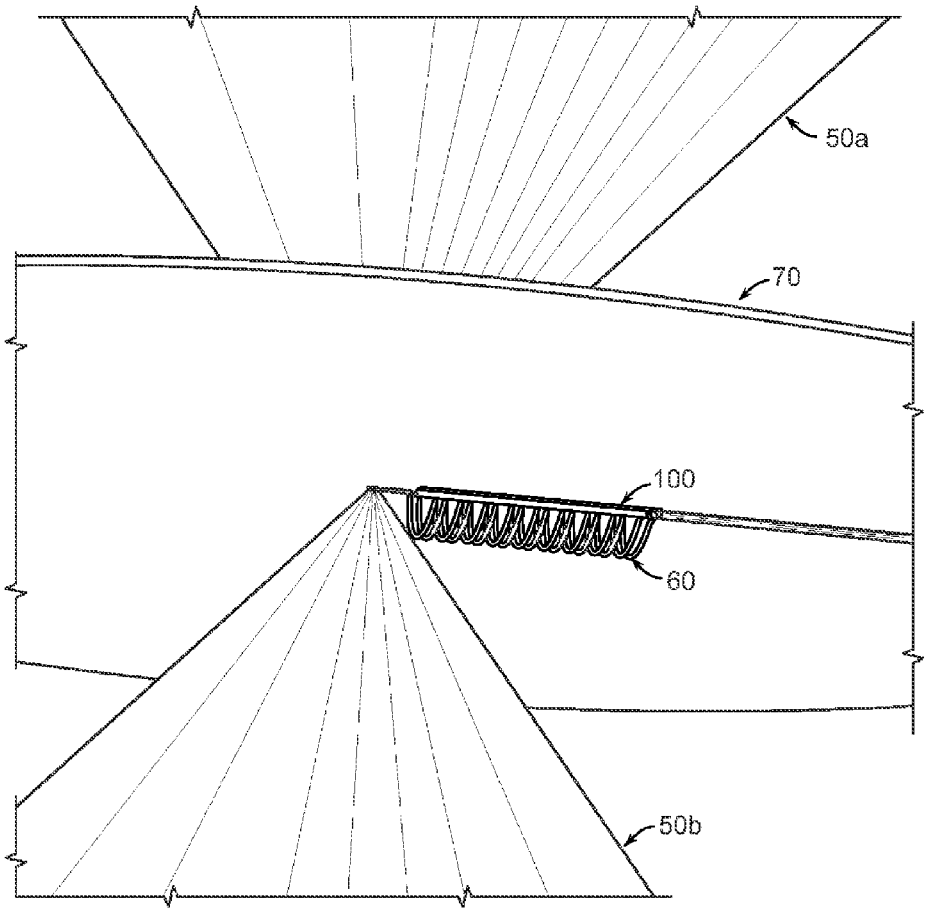
FIG. 6B is a three-dimensional, close-up view of the bifurcating ground plane shown in FIG. 6A illustrating one exemplary embodiment, in which the equal delay balun is implemented with a pair of bifilar helical transmission lines incorporated into the bifurcating ground plane.

FIG. 6B illustrates one manner in which the bifilar helical transmission lines 60 may be incorporated into the bifurcating ground plane 70 by arranging the bifilar helical transmission lines 60 within a cavity or void 100, which has been created within the ground plane 70 for this purpose. Although such an embodiment is specifically illustrated in FIG. 6B, a skilled artisan would understand how alternative means may be used for incorporating the transmission lines 60 into the ground plane 70.

Figure 7:
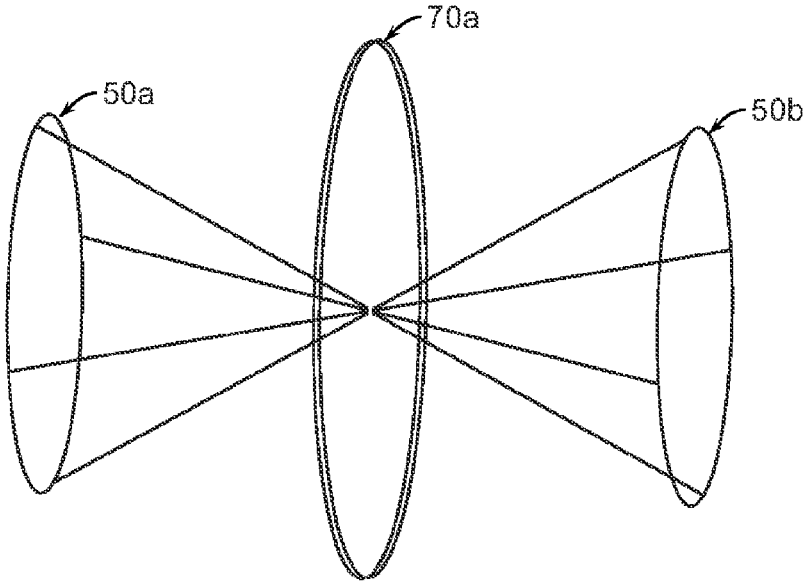
FIG. 7 is a numerical simulation illustrating the case in which a substantially circular ground plane of approximately 1000 mm in diameter is used to decouple the biconical elements.
Figure 8:
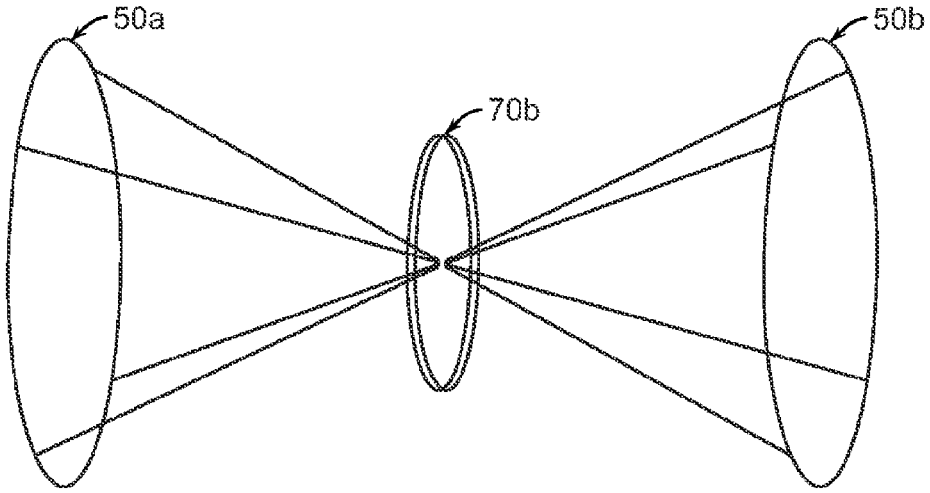
FIG. 8 is a numerical simulation illustrating the case in which a substantially circular ground plane of approximately 400 mm in diameter is used to decouple the biconical elements.

As noted above, the performance of the biconical antenna may be greatly improved by adding a bifurcating ground plane 70 between the antenna elements 50*a*, 50*b*, even if the ground plane itself is not very large. For example, FIGS. 7-8 illustrate the cases in which a substantially circular ground plane 70*a* of approximately 1000 mm in diameter (FIG. 7) and a substantially circular ground plane 70*b* of approximately 400 mm in diameter (FIG. 8) are used to decouple the biconical elements 50*a*, 50*b*. As indicated in the numerical simulations depicted in FIGS. 9-10 and described in more detail below, the significantly smaller (400 mm) ground plane 70*b* may provide the decoupling needed to substantially eliminate anomalous undulations in the biconical antenna's response without making the design to unwieldy. Such a ground plane may be preferable, in some embodiments, as a smaller ground plane is typically more manageable.

Figure 9:
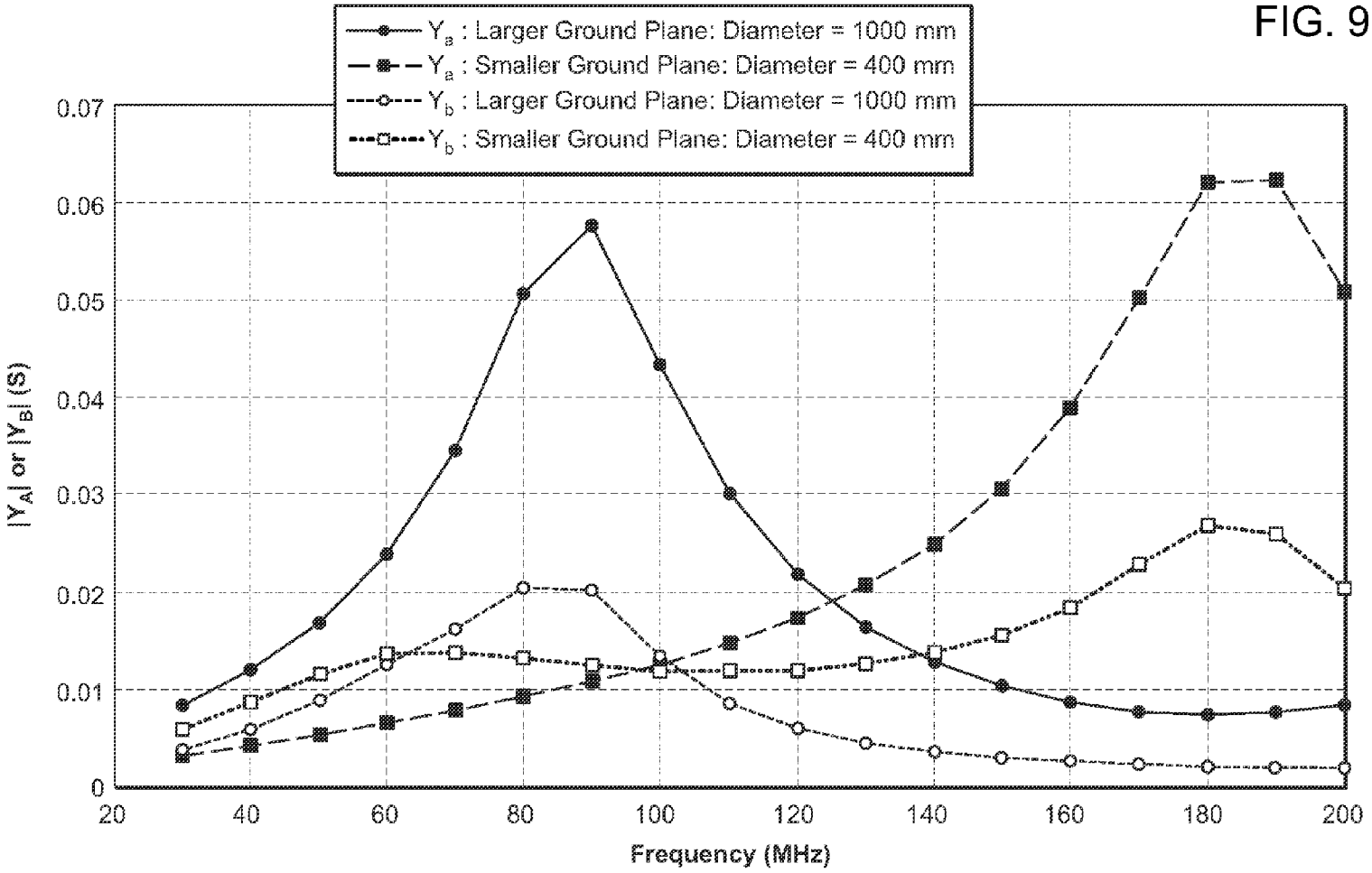
FIG. 9 is a graph which plots the magnitudes of the load elements ($Y_A$, $Y_B$ and $Y_C$) of the equivalent network for a 1.4 meter biconical antenna with a 400 mm diameter ground plane and a 1000 mm diameter ground plane.

In FIG. 9, the magnitudes of the load elements ($Y_A$, $Y_B$ and $Y_C$) of the equivalent $\Pi/\Delta$ network are plotted over a frequency range of 30-200 MHz. Note that $Y_A=Y_C$ for the symmetric antenna ground plane combination. For the larger 1000 mm diameter ground plane 70*a* shown in FIG. 7, the admittances to ground ($Y_A$ and $Y_C$) clearly dominates the bridging admittance ($Y_B$). However, for the smaller 400 mm diameter ground plane 70*b* shown in FIG. 8, $Y_A$ is still a significant fraction of $Y_B$ over the entire frequency range, which indicates that even a smaller (400 mm diameter) ground plane will provide good performance when coupled with a 1.4 meter biconical antenna.

Figure 10:
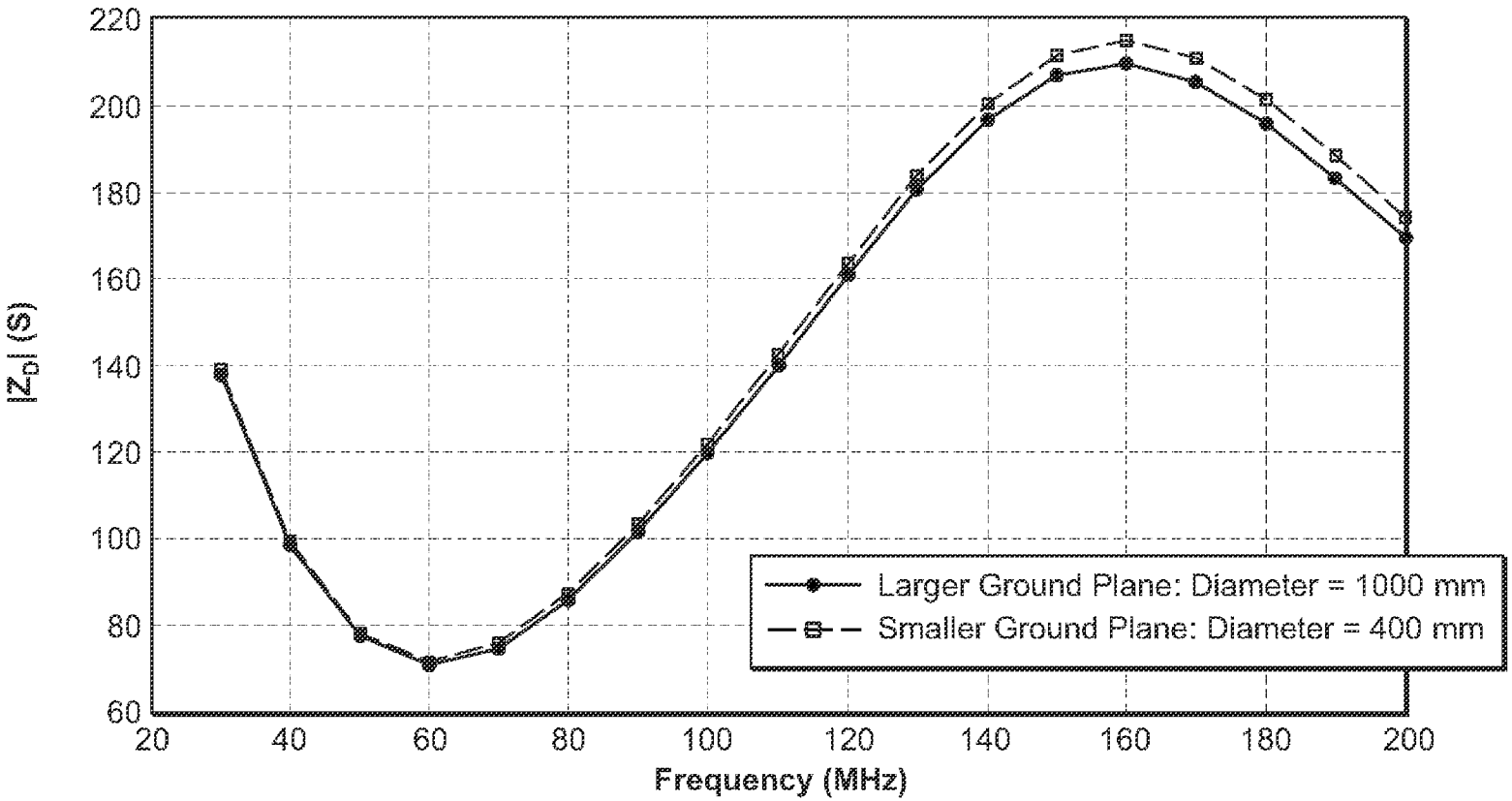
FIG. 10 is a graph which plots the magnitude of the two-terminal impedance ($Z_D$) seen by the current balun for a 1.4 meter biconical antenna with a 400 mm diameter ground plane and a 1000 mm diameter ground plane.

In FIG. 10, the magnitude of the two-terminal impedance ($Z_D$) seen by the current balun for a 1.4 meter biconical antenna with a 400 mm diameter ground plane (70*b*, FIG. 8) and a 1000 mm diameter ground plane (70*a*, FIG. 7) is plotted. As noted above, the two-terminal impedance ($Z_D$) seen by the current balun is $Z_D=1/Y_L$, where $Y_L=Y_B+(1/Y_A+1/Y_C)^{-1}$. The small difference between the curves is due to the finite thickness of the ground plane (in this example, 12 mm) as well as error in the finite element model. This data indicates that the impedances seen by a current balun for the biconical antenna with the larger and the smaller ground planes are essentially equal. In other words, because the bifurcating ground plane lies in the H-plane of symmetry of the antenna, the size of the bifurcating ground plane has essentially no effect on the differential mode input impedance, and thus, the behavior of the antenna/ground plane combination. Thus, smaller, less unwieldy ground planes may be preferred.

It will be appreciated to those skilled in the art having the benefit of this disclosure that this invention is believed to provide an improved biconical antenna design. More specifically, the invention adds a bifurcating ground plane between the biconical antenna elements. In some embodiments, the bifurcating ground plane may be arranged between the biconical antenna elements during a manufacturing step before the antenna/ground plane assembly is shipped to a customer. In other embodiments, a customer wishing to improve the performance of an existing biconical antenna may have a bifurcating ground plane retrofitted onto the existing antenna. When combined with an equal delay or Guanella balun, the bifurcating ground plane eliminates (or at least greatly ameliorates) the anomalous undulations which tend to occur at odd-integer average quarter-wave frequencies. Further modifications and alternative embodiments of various aspects of the invention will be apparent to those skilled in the art in view of this description. It is intended, therefore, that the following claims be interpreted to embrace all such modifications and changes and, accordingly, the specification and drawings are to be regarded in an illustrative rather than a restrictive sense.

What is claimed is:

1. A biconical antenna, comprising:

a pair of cone-shaped elements arranged back-to-back to one another and aligned along a first axis; and a ground plate arranged between the cone-shaped elements in a plane perpendicular to the first axis;

wherein the biconical antenna is driven by an equal-delay transformer, whose sum port is connected to the ground plate.

2. The biconical antenna recited in claim 1, wherein the biconical antenna is driven by an equal-delay transformer.

3. The biconical antenna recited in claim 1, wherein the ground plate has a finite thickness, the biconical antenna is driven by an equal-delay transformer, and the equal-delay transformer is enclosed in or embedded within the ground plate.

4. The biconical antenna recited in claim 1, wherein the cone-shaped elements are each formed from a substantially solid electrically-conductive material.

5. The biconical antenna recited in claim 1, wherein the cone-shaped elements are each formed from a wire-mesh, electrically-conductive material.

6. The biconical antenna recited in claim 1, wherein the cone-shaped elements are each formed by coupling together a plurality of metal wires or rods to form a cone-shaped structure.

7. The biconical antenna recited in claim 1, wherein the biconical antenna has a 60° cone angle.

8. A biconical antenna comprising:

a pair of cone-shaped elements arranged back-to-back to one another and aligned along a first axis; and a ground plate arranged between the cone-shaped elements in a plane perpendicular to the first axis, wherein the ground plate has a substantially circular shape.

9. A biconical antenna comprising:

a pair of cone-shaped elements arranged back-to-back to one another and aligned along a first axis; and a ground plate arranged between the cone-shaped elements in a plane perpendicular to the first axis, wherein the ground plate has a substantially elliptical shape.

10. A biconical antenna, comprising:

a pair of cone-shaped elements arranged back-to-back to one another and aligned along a first axis; and a ground plate arranged between the cone-shaped elements in a plane perpendicular to the first axis, wherein the ground plate has a smoothly contoured shape.

11. A biconical antenna, comprising:

a pair of cone-shaped elements arranged back-to-back to one another and aligned along a first axis;

a ground plate arranged between the cone-shaped elements in a plane perpendicular to the first axis; and an equal-delay transformer coupled for driving the pair of cone-shaped elements, wherein a sum-port of the equal-delay transformer is connected to the ground plate in a voltage balun configuration.

12. The biconical antenna recited in claim 11, wherein the ground plate is arranged, such that a center of the ground plate is located at an intersection of the first axis and the plane perpendicular to the first axis.

13. The biconical antenna recited in claim 11, wherein the ground plate is formed from substantially any electrically-conductive material, has a finite thickness, and has a smoothly contoured shape with symmetry in at least one dimension.

14. The biconical antenna recited in claim 11, wherein the equal-delay transformer is enclosed in or embedded within a cavity of the ground plate.

15. The biconical antenna recited in claim 11, wherein the equal-delay transformer comprises a pair of bifilar helical transmission lines.

16. A method for improving the performance of a biconical antenna driven by an equal-delay transformer, the method comprising:

arranging a conducting ground plate in an H-plane of the biconical antenna, such that the conducting ground plate bifurcates radiating elements of the biconical antenna; and connecting a sum-port of the equal delay transformer to the conducting ground plane, such that the radiating elements of the biconical antenna are driven with voltages that, with respect to the conducting ground plate, are substantially equal in magnitude but opposite in phase;

wherein the steps of arranging and connecting improve the performance of the biconical antenna by eliminating anomalous undulations that would otherwise occur in the antenna response due to mismatches in electrical length of transmission lines included within the equal delay transformer.

17. The method as recited in claim 16, further comprising placing the equal delay transformer within a cavity created within the conducting ground plate to electrically isolate the equal delay transformer from the radiating elements of the biconical antenna.

18. The method as recited in claim 17, wherein the equal delay transformer comprises a pair of bifilar helical transmission lines.

19. The method as recited in claim 17, wherein the steps of arranging, connecting and placing are performed during a manufacturing step before the biconical antenna is shipped to a customer, or as a retrofit to an existing biconical antenna.

* * * * *